United States Patent [19]

Myrick

[11] Patent Number: 4,800,998

[45] Date of Patent: Jan. 31, 1989

[54] ESCALATOR COMB SAFETY DEVICE

[75] Inventor: Ronald E. Myrick, Sudbury, Mass.

[73] Assignee: Otis Elevator Company, Farmington, Conn.

[21] Appl. No.: 146,747

[22] Filed: Jan. 21, 1988

[51] Int. Cl.[4] ..... B66B 29/06

[52] U.S. Cl. ..... 198/323; 198/325

[58] Field of Search ..... 198/323, 324, 325, 333

[56] References Cited

U.S. PATENT DOCUMENTS

| | | | |
|---|---|---|---|
| 3,233,717 | 2/1966 | Jin et al. | 198/323 |
| 3,913,723 | 10/1975 | Johnson | 198/323 |
| 3,934,699 | 1/1976 | Saito et al. | 198/323 |
| 4,088,219 | 5/1978 | Binns | 198/323 |
| 4,629,052 | 12/1986 | Kitamura | 198/323 |

FOREIGN PATENT DOCUMENTS

| | | | |
|---|---|---|---|
| 0374169 | 2/1964 | Switzerland | 198/323 |

*Primary Examiner*—Robert J. Spar
*Assistant Examiner*—Lyle Kimms
*Attorney, Agent, or Firm*—William W. Jones

[57] ABSTRACT

A safety device for use in the comb part of an escalator landing is operable to detect objects which pass into the comb from the escalator treads. The device includes a photodetector which is positioned beneath the comb and which detects a light beam projected across the comb where the treads pass through the comb. When a foreign object passes under the comb and blocks the light beam, this potential hazard is sensed by the detector. If the light beam remains blocked for a predetermined time period, the detector energizes and amplifier which in turn causes a relay to stop operation of the escalator motor.

4 Claims, 2 Drawing Sheets

ESCALATOR COMB SAFETY DEVICE

TECHNICAL FIELD

This invention relates to a safety device for use on an escalator to prevent personal injury and/or damage to the escalator in the event of a foreign object's passing beneath the tread comb at the exit landing of the escalator. More particularly, this invention relates to a escalator safety device which uses a photo detector positioned beneath the comb and operable to cause the escalator motor to stop in the event that a foreign object is detected beneath the comb.

BACKGROUND ART

Safety devices which guard against injury or damage on escalators are well known in the art. These devices are commonly related to the moving hand rail, or to the moving treads on the escalator. Points on the escalator which typically require the use of such safety devices are the point where the handrail enters the fixed housing to reverse its direction of movement, and the point where the treads enter the fixed landing to reverse their direction of movement. Devices have been proposed and used at these points for either stopping the escalator or sounding an alarm should a foreign object pass between the hand rail and its housing, or the treads and the landing. Some of these prior art devices will reverse the escalator when actuated to attempt to dislodge the foreign body which has actuated the device. Most of the prior art safety devices utilize some sort of mechanical sensor which is caused to move by contact from the foreign body. Typically, the floor plate, or part of it, and the landing, may be pulled up by something passing underneath the comb of the landing. When this movement occurs, and electrical contact will be made or broken, and the escalator motor may stop, an alarm may sound, the escalator may reverse its direction, or a combination of the foregoing may occur.

The aforesaid mechanical actuators can be prone to a number of operational problems which may render them inoperable. For example, the foreign body passing beneath the comb may not exert enough force on the device to cause the required movement to occur, or it may not occur in good time. This might be the case were a scarf or other light fabric to run beneath the comb. Another problem which is known to occur in connection with these safety devices is that they cannot work if someone is standing on the part that is supposed to move. Thus if a person who has an article of clothing caught beneath a tread comb, or someone trying to help that person, is standing on the comb or on the part of the landing that must move to trigger the safety device, the device will not work. Finally, devices of this type can become fouled by material deposited on the treads, and thus may stick and not operate properly.

DISCLOSURE OF THE INVENTION

The safety device of this invention operates without any moving sensors, so that there need be no mechanical movement induced by the foreign object to trip the device. The operating parts of the device are completely contained beneath the landing comb and are positioned out of the path of tread movement so as to be protected from fouling by material carried on the treads. The safety device of this invention utilizes a photo detector disposed beneath the landing sill to one side of the comb and moving tread path, which detects a light beam projected by a light source from a location on the opposite side of the comb and the tread path. The light source is also located beneath the landing sill. The teeth on the comb are undercut to form a tunnel through which the light beam is projected. The ends of the comb teeth which pass through the tread grooves are formed in their normal configuration and the undercut tunnel is just inwardly from the ends of the comb teeth. The light source and photo detector are positioned on either side of the treadway so that the beam of light will be projected through the tunnel just above the tops of the treads as they pass beneath the comb prior to reversing their direction. Any foreign object which passes beneath the comb will immediately block the light beam after clearing the ends of the comb teeth. Upon blocking of the light beam, the detector is activated. The detector is connected to an amplifier which, in turn, operates a relay through a time delay mechanism. The time delay ensures that the escalator will continue to run until the light beam has been continuously blocked for a predetermined time span, typically about one half second, after which the relay will be energized to stop movement of the escalator. With the time delay, the escalator will not be stopped when a fleeting and inconsequential blockage of the light beam occurs.

It is therefore an object of this invention to provide an improved safety device for escalators.

It is a further object of this invention to provide a safety device of the character described which stops the escalator treadway when a foreign object passes between the treads and the landing plate.

It is an additional object of this invention to provide a safety device of the character described which utilizes a photo detector disposed beneath the landing comb plate to detect the presence or absence of foreign material between the comb plate and the treadway.

These and other objects and advantages of the invention will become more readily apparent from the following detailed description of a preferred embodiment thereof when take in conjunction with the accompanying drawings, in which:

BEST MODE FOR CARRYING OUT THE INVENTION

Figure 1:
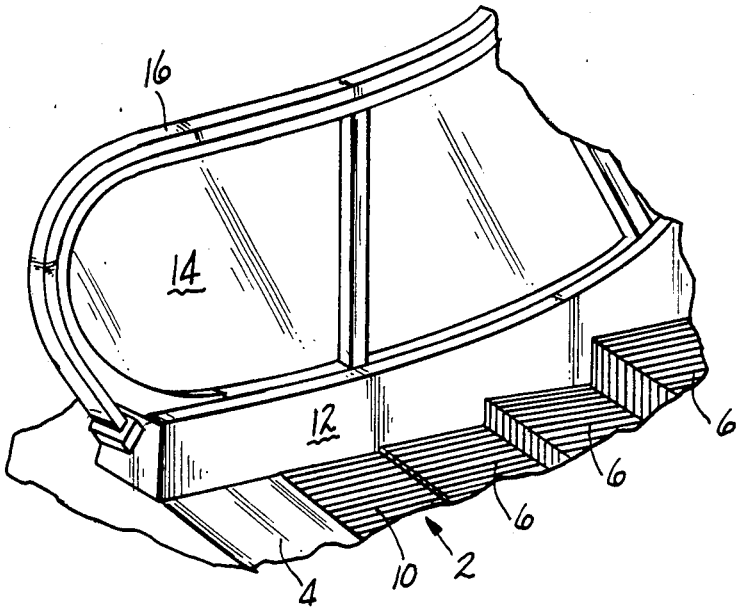
FIG. 1 is a fragmented perspective view of the landing portion of an escalator showing the handrail, treads, and landing plate with comb.

Referring now to the drawings, there is shown in FIG. 1 the exit landing area of an escalator denoted generally by the numeral 2. The escalator shown is the type having articulated treads mounted on a treadway which merge into a coplanar relationship at the exit landing and pass beneath a landing plate 4. The treads 6 are formed with spaced grooves 8 on their top surfaces which pass under a comb plate 10 which precedes the landing plate 4. While the escalator 2 shown in FIG. 1 is a "down" escalator, it will be appreciated that the invention can also be used at the exit landing of an "up" escalator, or with an appropriate horizontal moving walkway. On each side of the treads 6 is a skirt 12, and a balustrade 14 on which the moving handrail 16 is mounted.

Figure 2:
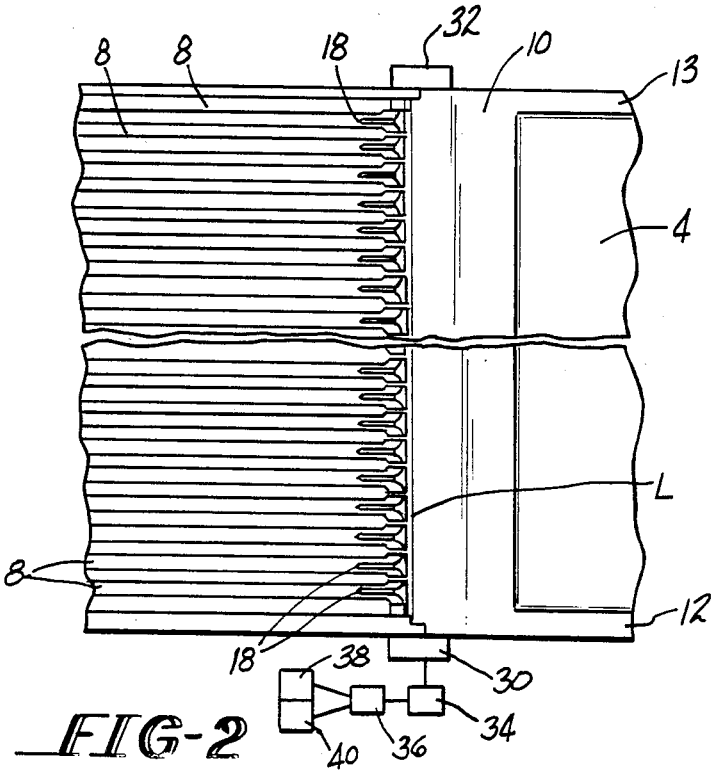
FIG. 2 is a fragmented plan view of the escalator landing area of FIG. 1.
Figure 3:
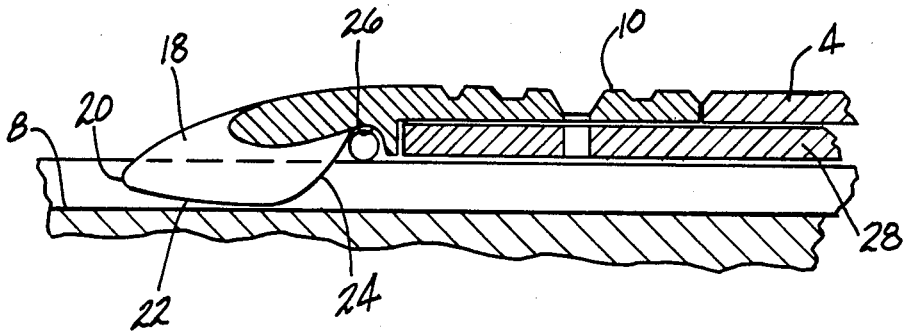
FIG. 3 is a vertical sectional view through the comb plate and treadway taken perpendicular to the photodetector beam path.

The comb plate 10 is formed with a plurality of teeth 18 which project into the tread grooves 8 and serve to prevent debris deposited in the grooves 8 from passing beneath the comb plate 10. Referring to FIG. 3, the profile of the comb teeth 18 is shown. The teeth 18 have a nose portion 20 which dips into the tread grooves 8, and a downwardly tapered bottom edge 22 which sweeps down almost to the bottom of the tread grooves 8. The bottom surface 22 rises sharply at an incline 24 distal of the nose 20 and forms a notch 26 adjacent to the base plate 28 to which the comb plate 10 is secured. The notches 26 on the teeth 18 are all aligned to define a transverse tunnel which spans the full width of the comb plate 10. As shown in FIG. 2, a photo detector 30 is mounted on the outside surface of one of the side skirts 12, and a light source 32 is mounted on the outside surface of the opposite skirt 13. There are apertures cut in the skirts 12 and 13 so that a beam of light can be projected from the light source 32 to the photo detector 30. The light source 32 and photo detector 30 are positioned at opposite ends of the tunnel formed by the aligned notches 26 in the comb teeth 18 so that anything passing beneath the comb plate 10 which is bulky enough to intrude into the tunnel will block the beam of light. Fine debris which passes beneath the comb plate 10 will not, however, interrupt the light beam. The detector 30 is the type which generates an electrical current when the light beam is interrupted. The detector 30 is connected to a signal amplifier 34 which in turn is connected to a relay 36. The amplifier strengthens the signal from the detector 30 and transmits the strengthened signal to the relay 36. The relay 36 has a built in delay of about one half second or so, so that the device will not be tripped by passage of irrelevant debris across the tunnel, such as bits of paper, or the like, which are able to get past the comb teeth 18. If the relay 36 stays energized for more than the prescribed time, then it deenergizes the motor 38 and concurrently deenergizes the coil on the brake 40, actuating the latter, whereby the escalator stops. An alarm can also be made to sound if so desired.

It will be readily appreciated that the safety device of this invention can be readily installed in existing escalators merely by retrofitting the old comb plate with a new comb plate modified to provide the tunnel. The side skirts can be drilled and the photo sensing assembly can be put in place. The device is dependable and well protected against damage or degradation. It will operate consistently regardless of where passengers are standing on the escalator. Adjustments can be made to increase or shorten the time delay responsive to operating conditions for the particular escalators in question.

Since many changes and variations of the disclosed embodiment of the invention may be made without departing from the inventive concept, it is not intended to limit the invention otherwise than as required by the appended claims.

What is claimed is:

1. A people moving assembly comprising:

(a) tread means for people to stand on while being conveyed by the assembly, said tread means being driven by a motor;

(b) means forming a landing plate at an exit end of said assembly upon which plate people will step when exiting from said tread means;

(c) a comb plate disposed adjacent said landing plate and facing said tread means, said tread means passing beneath said comb plate and said landing plate, and said tread means having an uppermost surface which moves along a horizontal path beneath said comb plate;

(d) means forming a gap beneath a bottom surface of said comb plate and said uppermost tread surface, said gap extending for the full breadth of said comb plate and tread means in a direction transverse to the direction of movement of said tread means;

(e) photosensor means at one end of said gap to one side of said path of travel;

(f) a brake operably connected to said photosensor means, and operable by said photosensor means to selectively brake said motor and thereby stop movement of said tread means; and (g) a light source at an opposite end of said gap on the opposite side of said path of travel, said light source being operable to project a beam of light through said gap to said photosensor means, whereby foreign objects entering said gap and blocking said beam of light will cause said photosensor means to actuate said brake to stop further movement of said tread means.

2. The assembly of claim 1 wherein said tread means comprises a plurality of articulated treads each having a plurality of parallel grooves disposed in its upper surface, and said comb plate comprises a plurality of teeth projecting toward said treads for reception in said grooves as each tread passes beneath said comb plate, said gap being formed by aligned portions of said comb teeth which are undercut above the plane of said top surface of said treads.

3. The assembly of claim 2 further comprising opposite side skirts flanking said tread means, and said photosensor means, said light source each being mounted on a side of said skirts away from said tread means, and each of said skirts being provided with openings which are aligned with said undercut portions of said comb teeth whereby said light beam is projected through said skirt openings from said light source to said photosensor means.

4. The assembly of claim 3 wherein said photosensor means is operably connected to a signal delay having a preset duration, whereby said motor will not be stopped until said light beam is blocked for a time period exceeding said preset duration.

* * * * *